US007731158B1

(12) United States Patent
Hsieh

(10) Patent No.: US 7,731,158 B1
(45) Date of Patent: Jun. 8, 2010

(54) INSERT TYPE CHAIN HOIST

(75) Inventor: Chih-Tsao Hsieh, Lujhu Township (TW)

(73) Assignee: Inno Digic Ltd., Lujhu Township (TW)

( * ) Notice: Subject to any disclaimer, the term of this patent is extended or adjusted under 35 U.S.C. 154(b) by 0 days.

(21) Appl. No.: 12/426,247

(22) Filed: Apr. 18, 2009

(51) Int. Cl.
*B66D 1/20* (2006.01)

(52) U.S. Cl. ..... 254/358; 254/344; 254/346; 254/372

(58) Field of Classification Search ..... 254/342, 254/344, 346, 358, 372, 354; 160/310; 149/139, 149/199
See application file for complete search history.

(56) References Cited

U.S. PATENT DOCUMENTS 3,092,369 A * 6/1963 Carroll ..... 254/343
5,203,392 A * 4/1993 Shea ..... 160/7
6,092,582 A * 7/2000 Liu ..... 160/310
6,155,324 A * 12/2000 Elliott et al. ..... 160/1
6,381,903 B1 * 5/2002 Desrochers et al. ..... 49/139
6,422,965 B1 * 7/2002 Balli et al. ..... 475/149
7,299,847 B1 * 11/2007 Evans ..... 160/1
7,533,869 B2 * 5/2009 Boda et al. ..... 254/352
7,614,610 B2 * 11/2009 Xia et al. ..... 254/372
2002/0121633 A1 * 9/2002 Fujikawa ..... 254/358
2003/0089897 A1 * 5/2003 Hodge ..... 254/344
2003/0197160 A1 * 10/2003 Curtis ..... 254/358
2008/0078980 A1 * 4/2008 Aho et al. ..... 254/344
2009/0108245 A1 * 4/2009 Daus et al. ..... 254/354

* cited by examiner

*Primary Examiner*—Evan H Langdon

(57) ABSTRACT

A insert type chain hoist includes a base disc having a transmission disc and a driving disc installed on a side of the base disc. The base disc includes a pivotal pillar disposed at the central position of a lateral surface of the base disc and pivotally connected to the transmission disc and the driving disc, a manual device installed on a surface of the base disc, and a driver for driving the transmission disc. The manual device includes a chain hoist drive wheel installed on the same surface of the base disc and the pivotal pillar for driving the transmission disc. The chain hoist drive wheel is connected to the manual pillar. A sleeve is sheathed onto an end of the manual pillar. A chain hoist is positioned at another end of the sleeve and away from the manual pillar. Users can use the manual device to roll a rolling door quickly and easily.

9 Claims, 8 Drawing Sheets

INSERT TYPE CHAIN HOIST

BACKGROUND OF THE INVENTION

1. Field of the Invention

The present invention relates to an insert type chain hoist, and in particular to a chain hoist installed in a rolling door driving device and provided for users to open or close a rolling door manually.

2. Description of the Related Art

Doors play an important role for ensuring the security of a premisis and to provide protection against the environment. However, a conventional rolling door employs a motor connected to a rotating shaft, such that the motor can drive the rotating shaft to rotate and drive the door panel to be rolled and unrolled to achieve the effects of opening and closing the rolling door. To prevent the rolling door from being unable to open or close during a power failure, a winch is installed at the back of the motor through a motor axle, so that users can use a hinge chain of the winch to pull the motor axle in order to roll or unroll the door panel.

However, such an arrangement has the following shortcomings:

1. Since the motor brakes on power failure or disconnection, users require a large force to pull the winch. If a gearbox is used to reduce the required pulling force, then the ascending or descending speed of the door panel will be significantly reduced (at present, most rolling doors adopt this method), and it usually takes more than ten minutes to open or close a rolling door.

2. A gearbox is used to reduce the required pulling force, and the volume of the gearbox is very large, and thus a large installation space is needed, and such arrangement is obviously not suitable for many situations.

SUMMARY OF THE INVENTION

It is a primary objective of the present invention to provide a manual device for users to activate a rolling door quickly and easily.

To achieve the foregoing objective, the present invention provides a base disc, comprising a transmission disc and a driving disc sequentially installed on a side of the base disc. The base disc includes a pivotal pillar disposed at the central position on a lateral surface of the base disc and is pivotally coupled to the transmission disc and the driving disc, a manual device installed at a surface of the base disc, and a driver for driving the transmission disc. The manual device includes a chain hoist drive wheel installed at the base disc and on the same side of the pivotal pillar for driving the transmission disc. The chain hoist drive wheel is connected to a manual pillar, and a sleeve is sheathed onto an end of the manual pillar. A chain hoist is positioned at another end of the sleeve and away from the manual pillar.

DETAILED DESCRIPTION OF THE PREFERRED EMBODIMENTS

Figure 1:
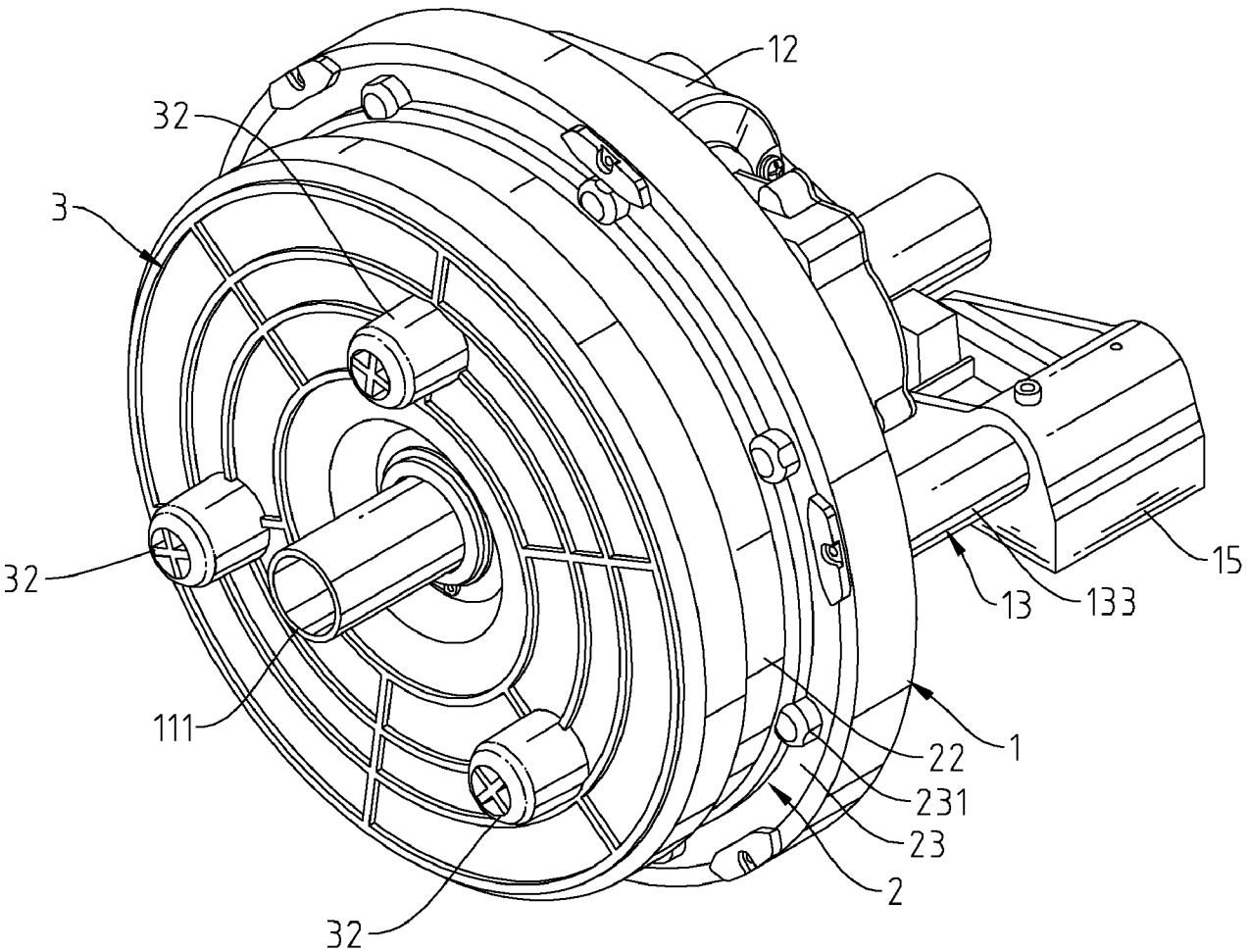
FIG. 1 is a perspective view of the present invention.
Figure 2:
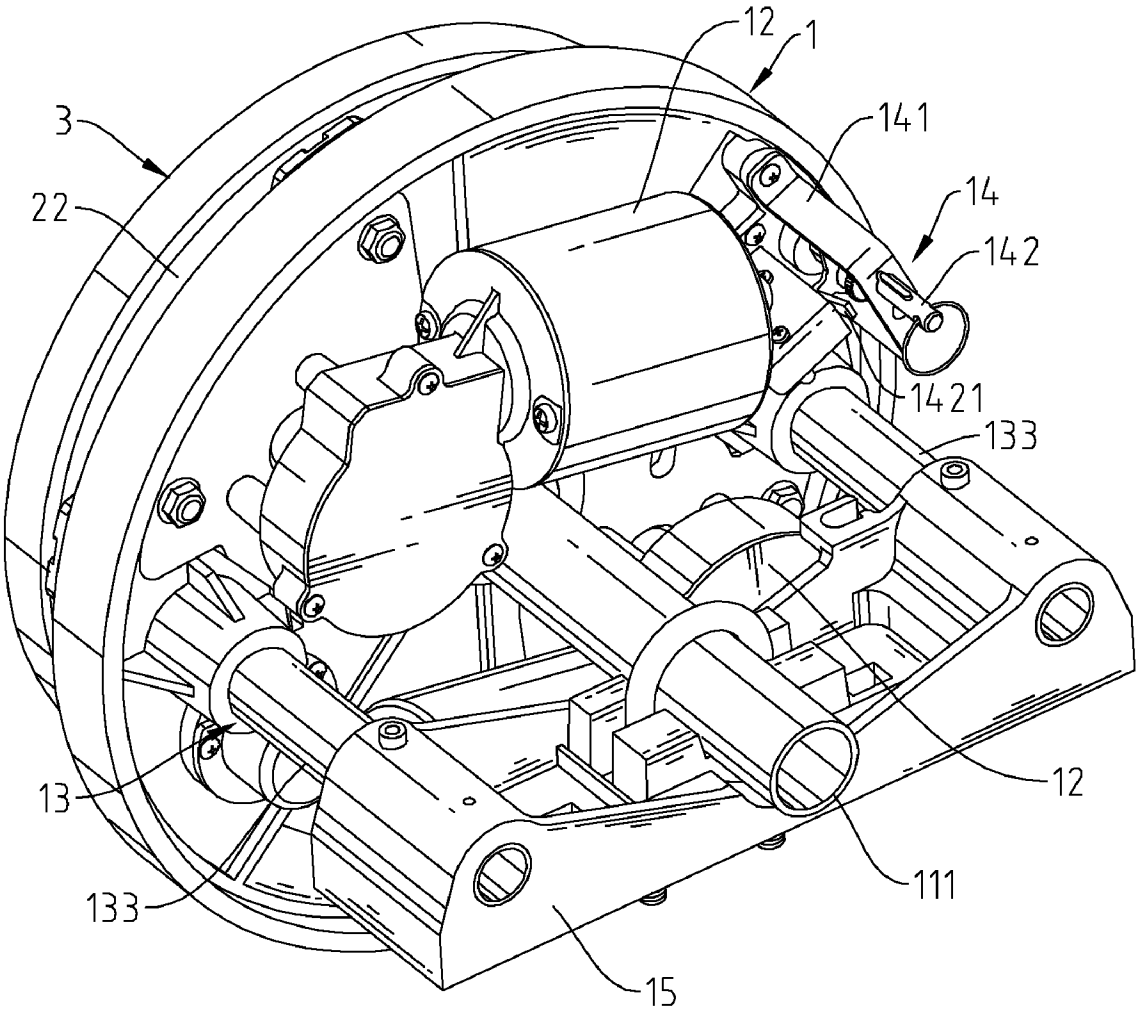
FIG. 2 is a perspective view of the present invention viewed from another angle.
Figure 3:
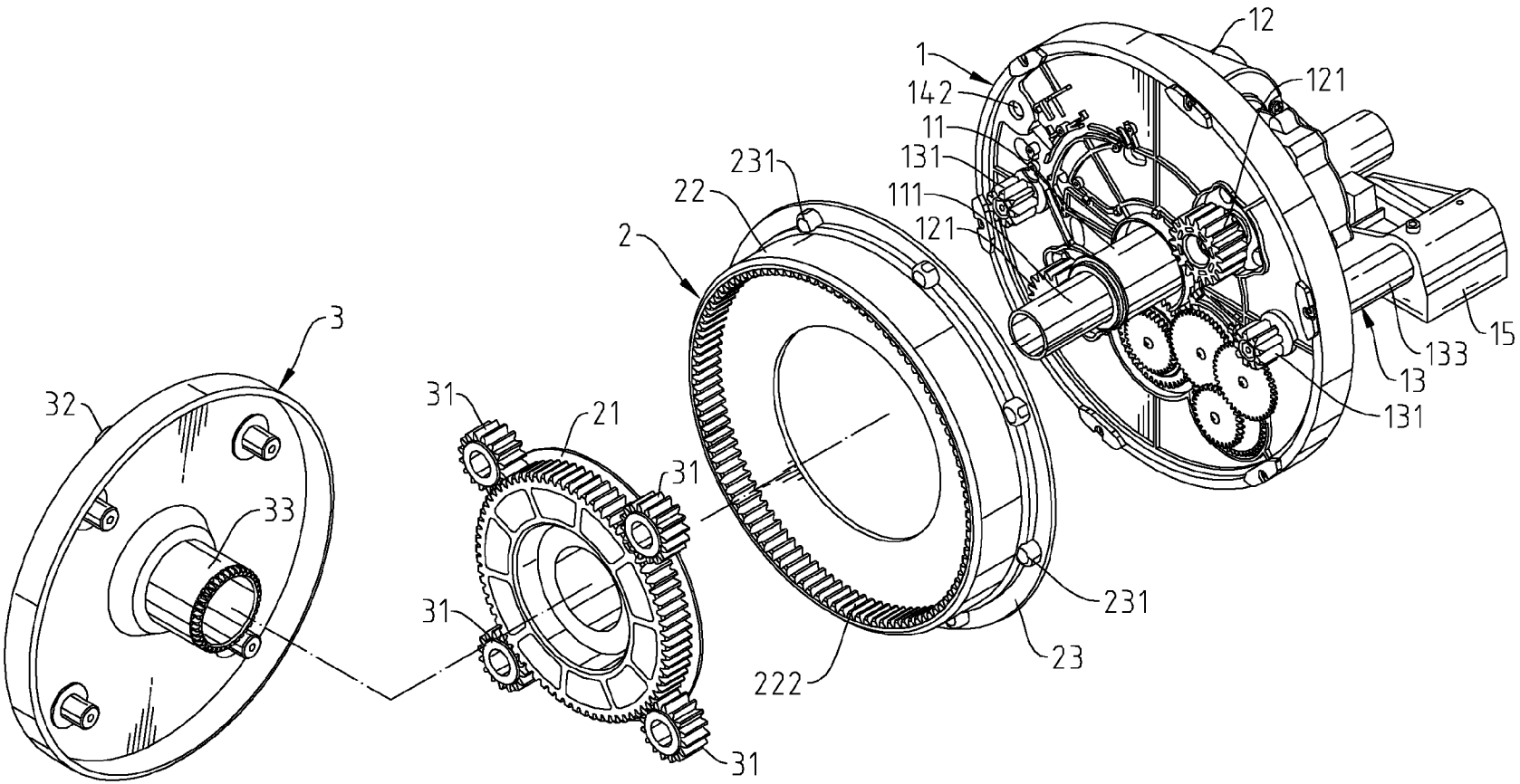
FIG. 3 is an exploded view of the present invention.
Figure 4:
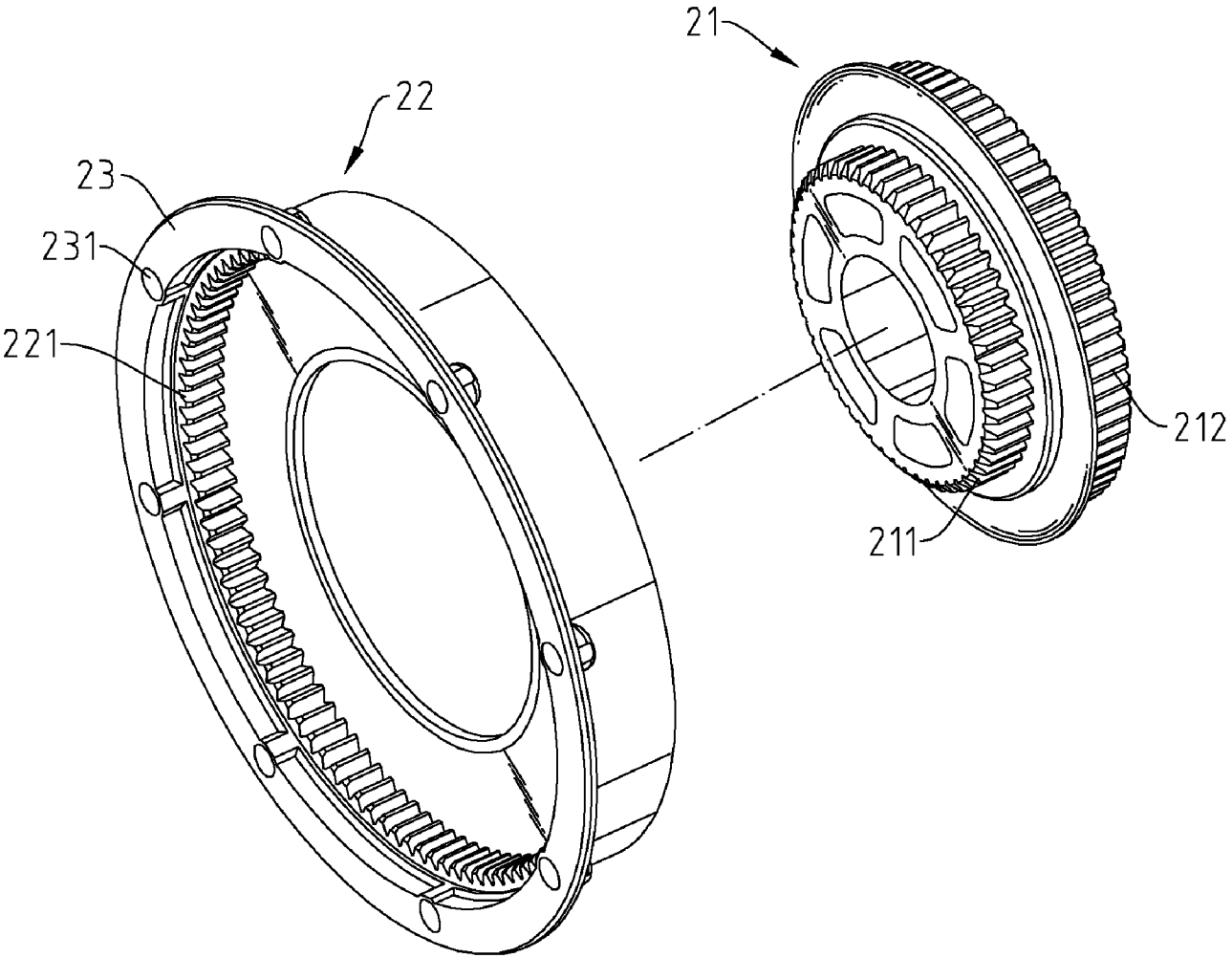
FIG. 4 is a perspective view of a transmission disc of the present invention.

With reference to FIGS. 1 to 6, an insert type chain hoist of the present invention comprises a base disc 1, a transmission disc 2 and a driving disc 3.

The base disc 1 includes a pivotal pillar 11 extended from the central position of a lateral surface of the base disc 1, a support pillar 111 passed into the pivotal pillar 11, a fixing base 15 disposed on another side of the base disc 1 and away from the pivotal pillar 11 and fixed to the top of a door frame (not shown in the figure) for fixing an end of the support pillar 111 to the fixing base 15, a driver 12 installed between the base disc 1 and the fixing base 15, a plurality of sets of manual devices 13 and clutches 14, a driving gear 121 installed at the driver 12 and on the same side of the pivotal pillar 11 for connecting the driving gear 121 to the driver 12. The manual device 13 includes a chain hoist drive wheel 131 installed at the base disc 1 and on the same surface of the pivotal pillar 11. The chain hoist drive wheel 131 is connected to the manual pillar 132 such that the manual pillar 132 is extended and passed through the base disc 1 and pivotally coupled to the base disc 1. A sleeve 133 is sheathed to an end of the manual pillar 132, and the sleeve 133 is fixed to the fixing base 15 at another end away from the manual pillar 132. A chain hoist 16 is installed and positioned at an end of the sleeve 133, with a chain 161 installed around the external periphery of the chain hoist 16. The clutch 14 includes a positioning base 141 fixed to a surface of the base disc 1. The positioning base 141 includes a positioning pillar 142 passed through the positioning base 141 and a micro switch 143 installed on a side of the positioning base 141. The positioning pillar 142 includes a poking plate 1421 for triggering the micro switch 143 when the positioning pillar 142 is moved.

The transmission disc 2 is disposed on a side of the base disc 1. The transmission disc 2 includes a primary gear disc 21, and the central position of the primary gear disc 21 is pivotally coupled to the pivotal pillar 11 of the base disc 1. The primary gear disc 21 includes a first primary gear 211 and a second primary gear 212 installed on both sides of the periphery of the primary gear disc 21 respectively, and the first primary gear 211 is engaged with the driving gear 121 of the driver 12. The primary gear disc 21 includes a secondary gear disc 22 installed around the external periphery of the primary gear disc 21. The secondary gear disc 22 includes a first driven gear 221 and a second driven gear 222 installed on both surfaces of the periphery of the secondary gear disc 22 respectively for engaging the first driven gear 221 and the chain hoist drive wheel 131. The second driven gear 222 and the second primary gear 212 form an interval apart, and the secondary gear disc 22 includes a positioning portion 23 extended from the periphery of the secondary gear disc 22. The positioning portion 23 includes a plurality of positioning holes 231 disposed on a surface of the positioning portion 23 for passing and positioning the positioning pillar 142.

The driving disc 3 is disposed on another side of the base disc 1 and away from the transmission disc 2, and a plurality of driving gears 31 are installed around the surface of the driving disc 3. Each driving gear 31 is situated between the second driven gear 222 and the second primary gear 212 for engaging each driving gear 31 with the second driven gear 222 and the second primary gear 212. The driving disc 3 includes a plurality of connecting bases 32 protruding from another surface away from the transmission disc 2 for connecting with and fixing to a rolling door (not shown in the figure) and a socketed pipe 33 extending from the central position of another surface away from the connecting base 32 and passed through the primary gear disc 21 and sheathed to an external side of the pivotal pillar 111.

Figure 5:
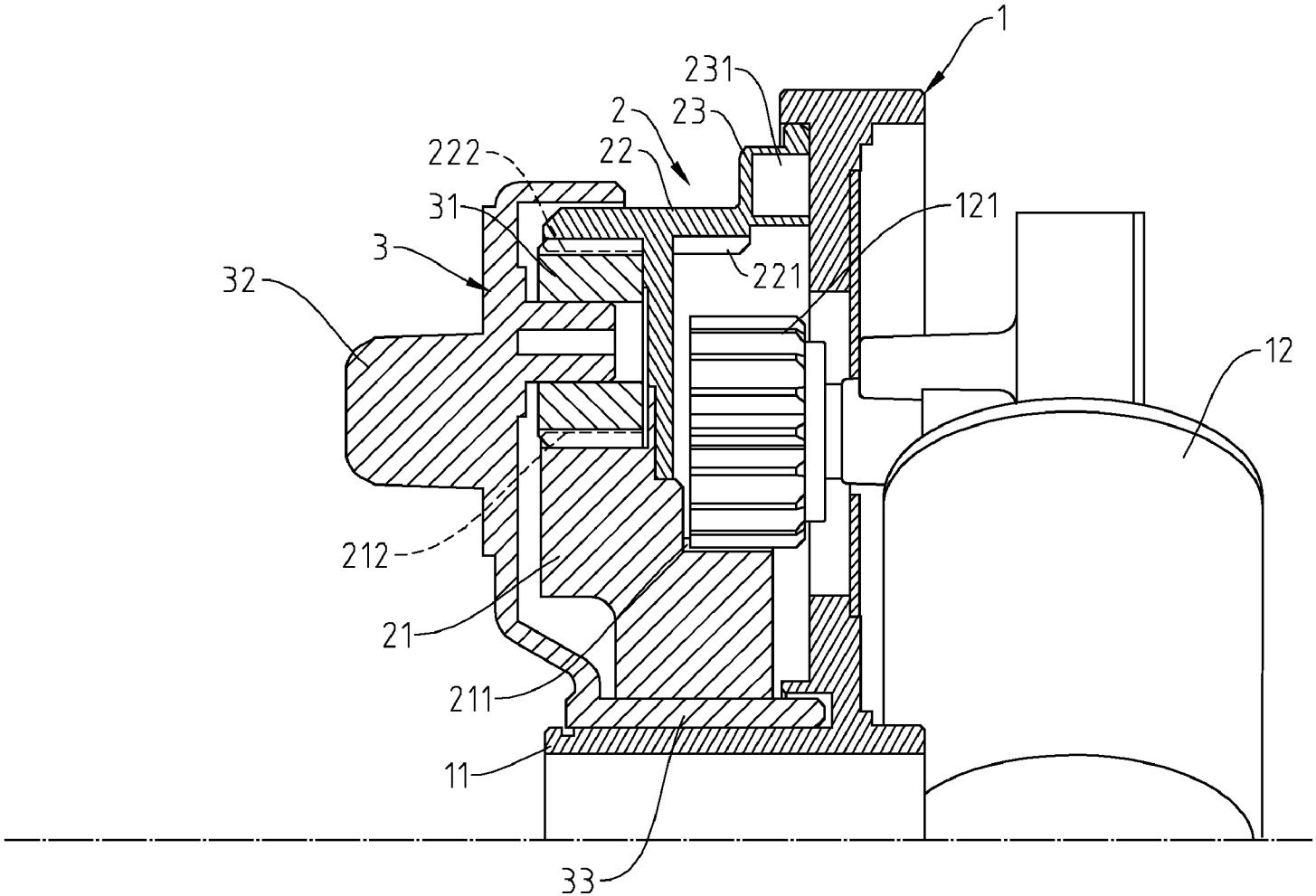
FIG. 5 is a partial cross-sectional view of rotating a primary gear disc in accordance with the present invention.
Figure 8:
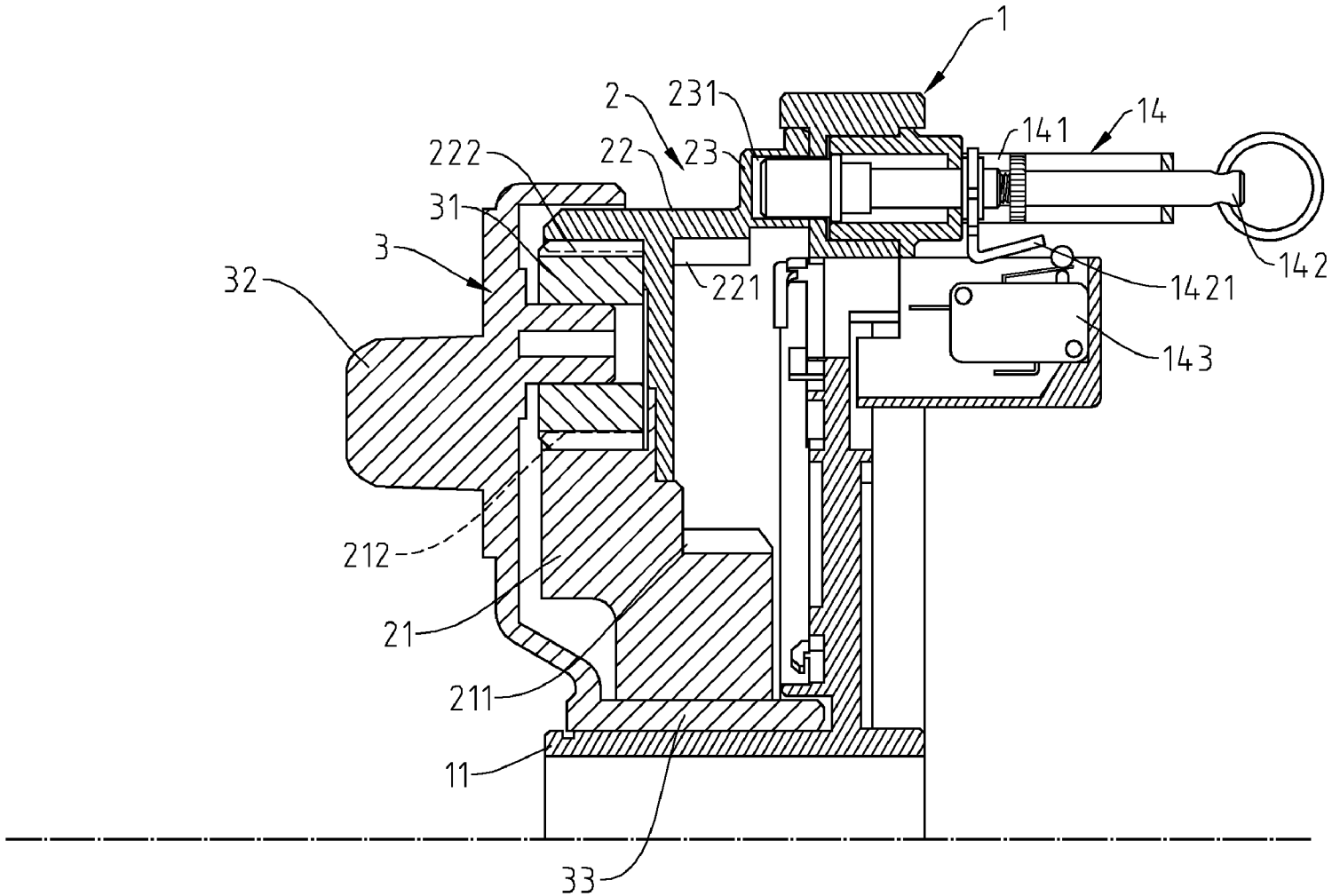
FIG. 8 is a partial cross-sectional view of a clutch in a locked state in accordance with the present invention.

With reference to FIGS. 5 and 8, an end of the positioning pillar 142 of the clutch 14 is inserted into the positioning hole 231 of the secondary gear disc 22 before the present invention uses the driver 12 for its operation. The secondary gear disc 22 and the base disc 1 are fixed to their positions without being rotated, and the micro switch 143 installed at the clutch 14 is in an off state (as shown in FIG. 9). Now, a user can use an electric control device (not shown in the figure) to control and operate the driver 12 to drive the driving gear 121 to rotate. Since the first primary gear 211 of the primary gear disc 21 is engaged with the driving gear 121, the primary gear disc 21 is driven to rotate together with the pivotal pillar 11 of the base disc 1, when the driving gear 121 is rotated. If the primary gear disc 21 is rotated, the second primary gear 212 of the primary gear disc 21 will drive the driving gear 31 of the driving disc 3 to rotate. Since the secondary gear disc 22 and the base disc 1 are fixed and will not be rotated, therefore the driving gear 31 will rotate and moves in the same direction towards the second driven gear 222 of the secondary gear disc 22. Since the driving gear 31 is pivotally coupled to the driving disc 3, the driving disc 3 is rotated together with the pivotal pillar 11 of the base disc 1, so as to roll or unroll the rolling door connected to the driving disc 3 (as shown in FIG. 5).

Figure 6:
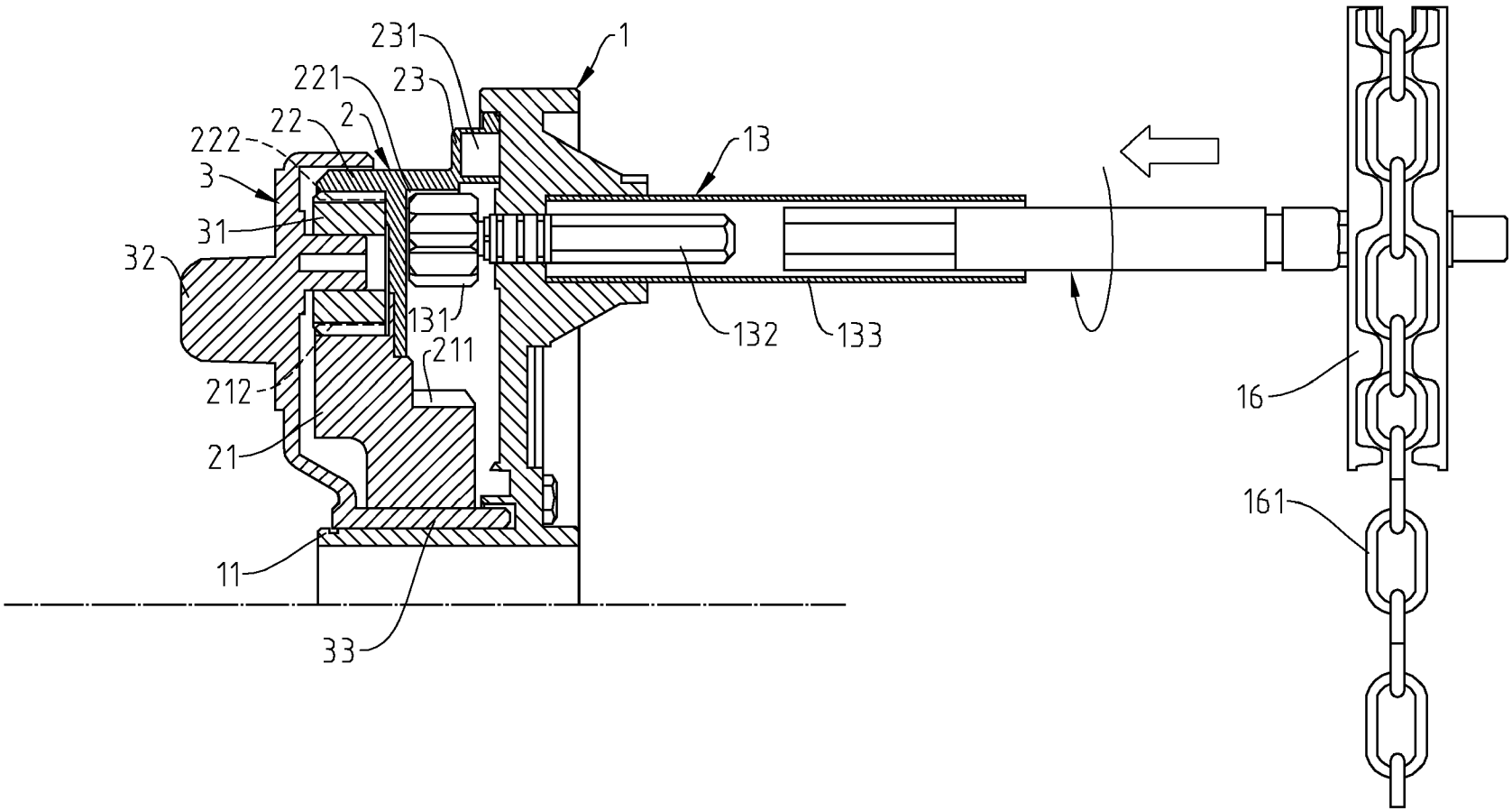
FIG. 6 is a partial cross-sectional view of rotating a secondary gear disc in accordance with the present invention.
Figure 7:
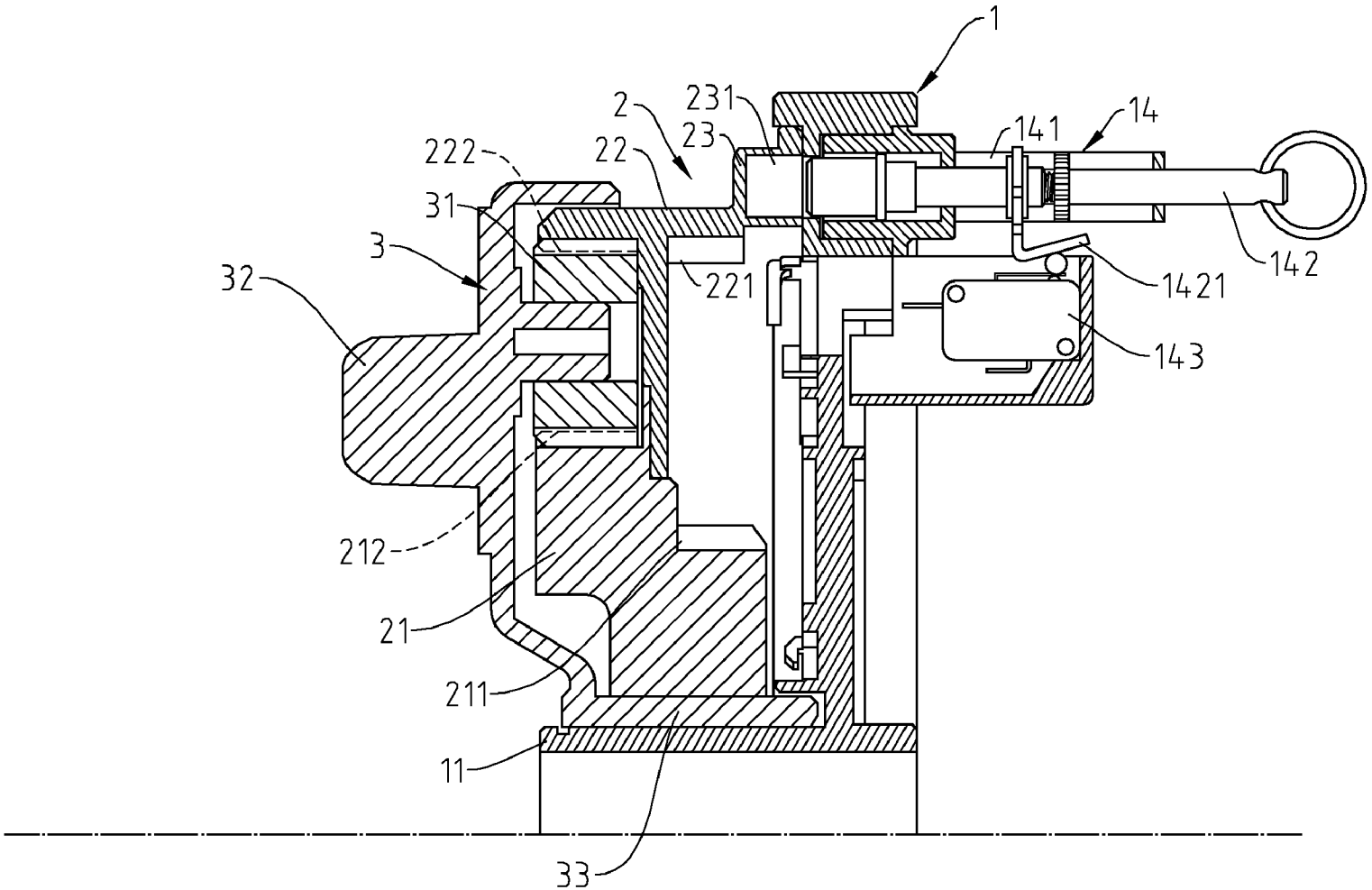
FIG. 7 is a partial cross-sectional view of a clutch in an unlocked state in accordance with the present invention.

With reference to FIGS. 6 and 7, a user lifts the positioning pillar 142 of the clutch 14 to separate an end of the positioning pillar 142 from the positioning hole 231 of the secondary gear disc 22 to let the secondary gear disc 22 rotate freely when the user wants to pull the rolling door manually. If the positioning pillar 142 is lifted, a poking plate 1421 of the positioning pillar 142 will trigger the micro switch 143 (as shown in FIG. 8), and the micro switch 143 will disconnect the power of the driver 12 (as shown in FIG. 5) to stop the operation. Now, the user can pull the chain 161 of the chain hoist 16 to turn the chain hoist 16. Since the chain hoist 16 is fixed to an end of the sleeve 133, and another end of the sleeve 133 is fixed to the manual pillar 132, therefore the chain hoist 16 can be turned to drive the chain hoist drive wheel 131 connected to the manual pillar 132 to rotate. Since the chain hoist drive wheel 131 is engaged with the first driven gear 221 of the secondary gear disc 22, therefore the secondary gear disc 22 will be rotated at the same time. The driver 12 is electrically disconnected, and thus the driver 12 will stop the rotation (as the motor is at a braking status), and the driving gear 121 and the primary gear disc 21 connected to the driving gear 121 cannot not be rotated. Now, the secondary gear disc 22 is rotated to drive the driving gear 31 to rotate and move in the same direction towards the second primary gear 212 of the primary gear disc 21 (as shown in FIG. 7). The driving gear 31 is pivotally coupled to the driving disc 3, and thus the driving disc 3 can be rotated with the pivotal pillar 11 of the base disc 1 to roll or unroll the rolling door connected to the driving disc 3.

In summation of the description above, the present invention can overcome the deficiencies and shortcomings of the prior art by using a chain hoist drive wheel 131 to drive the secondary gear disc 22 to rotate, so that when the secondary gear disc 22 is rotated, the driving gear 31 is driven at the same time to rotate and move towards the second primary gear 212 of the primary gear disc 21, so as to rotate the driving disc 3 together with the pivotal pillar 11 of the base disc 1 and roll or unroll the rolling door connected to the driving disc 3. Users can roll or unroll the rolling door quickly and easily. In addition, the chain hoist drive wheel 131 is installed at the transmission disc 2, so that the invention can save the installation space and simplify the installation procedure effectively.

What is claimed is:

1. An insert type chain hoist to enable a user to roll or unroll a rolling door manually, comprising a base, a transmission disc and a driving disc, wherein:

the base disc includes a pivotal pillar extending from a central position of a lateral surface of the base disc, a driver and a clutch installed on another side of the base disc and away from the pivotal pillar, a manual device installed on the base disc, and a chain hoist drive wheel coupled with the manual device and on the same surface of the base disc 1 as the pivotal pillar 11, the chain hoist drive wheel coupled to a manual pillar, and the manual pillar extending and passing through the base disc and pivotally coupled to the base disc;

wherein the transmission disc is disposed on a side of the base disc, and the transmission disc includes a primary gear disc, and the central position of the primary gear disc is pivotally coupled to the pivotal pillar of the base disc, and a first primary gear and a second primary gear are installed on both sides of the periphery of the primary gear disc respectively, and the first primary gear is driven by the driver to rotate the primary gear disc on the pivotal pillar, and the transmission disc includes a secondary gear disc coupled to the external periphery of the primary gear disc, and the secondary gear disc includes a first driven gear and a second driven gear installed on both surfaces of the periphery of the secondary gear disc respectively, such that the first driven gear and the chain hoist drive wheel are engaged with each other, and the second driven gear and the second primary gear form an interval apart, and the periphery of the secondary gear disc is positioned by the clutch to fix the secondary gear disc at the positioning portion of the base disc 1; and the driving disc is disposed on another side of the transmission disc and away from the base disc, and the driving disc includes a plurality of driving gears installed around a surface of the driving disc, and each driving gear is installed between the second driven gear and the second primary gear and engaged with the second driven gear and the second primary gear.

2. The insert type chain hoist of claim 1, wherein the pivotal pillar includes a support pillar passed through the pivotal pillar, and an end of the support pillar is fixed to a fixing base disposed on a side of the base disc.

3. The insert type chain hoist of claim 1, wherein the base disc includes a driving gear installed on the same surface of the pivotal pillar, and the driving gear is coupled to the driver and engaged with the first primary gear.

4. The insert type chain hoist of claim 1, wherein the manual device comes with one or more sets.

5. The insert type chain hoist of claim 1, wherein the manual device includes a sleeve, and an end of the sleeve is sheathed to an end of the manual pillar, and another end of the sleeve is fixed to a fixing base disposed on a side of the base disc.

6. The insert type chain hoist of claim 5, wherein the sleeve is provided for positioning a chain hoist at another end away from the manual pillar.

7. The insert type chain hoist of claim 1, wherein the clutch includes a positioning base fixed to a surface of the base disc and the positioning base includes a positioning pillar passed through the positioning base, and the positioning portion includes a plurality of positioning holes disposed on a surface of the positioning portion for passing and positioning the positioning pillar.

8. The insert type chain hoist of claim 7, wherein the clutch includes a micro switch installed on a side of the positioning base, and the positioning pillar includes a poking plate for triggering the micro switch when the positioning pillar is moved.

9. The insert type chain hoist of claim 1, wherein the driving disc includes a plurality of connecting bases protruded from another surface away from the transmission disc for connecting and fixing the rolling door, and a socketed pipe extended from the central position of another surface away from the connecting base.

* * * * *